United States Patent [19]

Thorn et al.

[11] 4,445,102

[45] Apr. 24, 1984

[54] MAGNET POLE TIPS

[75] Inventors: Craig E. Thorn, Wading River; Chellis Chasman, Setauket; Anthony J. Baltz, Coram, all of N.Y.

[73] Assignee: The United States of America as represented by the United States Department of Energy, Washington, D.C.

[21] Appl. No.: 323,150

[22] Filed: Nov. 19, 1981

[51] Int. Cl.[3] ..... H01F 3/00

[52] U.S. Cl. ..... 335/297; 313/62

[58] Field of Search ..... 335/210, 296, 297; 313/62

[56] References Cited

U.S. PATENT DOCUMENTS 3,175,131 3/1965 Burleigh et al. ..... 313/62 X 3,434,085 3/1969 Gang ..... 335/297

OTHER PUBLICATIONS

H. A. Howe, "Model Magnet Work at NRDL", Proceedings of the Conference on Sector Focussed Cyclotrons, Sea Island, GA, 1959, Nuclear Science Series, Report No. 26, p. 119, (1959).

"Proposal for a Cyclotron Addition to the Brookhaven Tandem Facility", Brookhaven National Laboratory Informal Report No. BNL 27072, (Jan. 1980).

*Primary Examiner*—George Harris

*Attorney, Agent, or Firm*—Margaret C. Bogosian; Bruce R. Mansfield; Michael F. Esposito

[57] ABSTRACT

An improved magnet which more easily provides a radially increasing magnetic field, as well as reduced fringe field and requires less power for a given field intensity. The subject invention comprises a pair of spaced, opposed magnetic poles which further comprise a pair of pole roots, each having a pole tip attached to its center. The pole tips define the gap between the magnetic poles and at least a portion of each pole tip is separated from its associated pole root. The separation begins at a predetermined distance from the center of the pole root and increases with increasing radial distance while being constant with azimuth within that portion. Magnets in accordance with the subject invention have been found to be particularly advantageous for use in large isochronous cyclotrons.

10 Claims, 13 Drawing Figures

MAGNET POLE TIPS

BACKGROUND OF THE INVENTION

The U.S. Government has rights in this invention pursuant to Contract Number DE-AC02-76CH00016, between the U.S. Department of Energy and Associated Universities, Inc.

This Invention relates to magnets, and more particularly to an improved magnetic pole tip.

It is frequently necessary for scientific experiments or for other purposes to provide a region of intense, magnetic field, having a prescribed normalized radial intensity distribution "or shape", where the intensity of the magnetic field may be varied. Typically, this is done with an electromagnet. However, permanent magnets may also be used. FIG. 1 shows a cross-section of a portion of such an electromagnet. Pole pieces 10 and 12 are separated by a magnetic gap 14. Pole pieces 10 and 12 are formed from a low reluctance material such as iron and are connected by a magnet yoke (not shown). A coil (not shown) is also provided and surrounds the yoke so that when a current is passed through the coil a magnetic field, shown by flux lines 16, is generated in the yoke and pole pieces 10 and 12. At magnetic gap 14, where flux lines 16 pass between pole pieces 10 and 12, the field is accessible for the intended purpose.

One inherent problem with electromagnetic apparatus such as that shown in FIG. 1 may be seen by examining flux lines 16. Near the center of magnetic gap 14 flux lines 16 are parallel and uniformly spaced, showing a uniform magnetic field. As you move out radially flux lines 16 begin to bow outwards and spread further apart. A typical plot of magnetic field, B, vs. radius, r, is shown in FIG. 2. It can be seen that the field decreases with increasing radius and that a significant field may be observed outside gap 14 (i.e. beyond R, the pole radius).

This effect, which is known as the "fringing" effect has three harmful results. First, it makes it difficult to obtain a field which does not decrease with increasing radius; the fringe field flux is lost to gap 14 and increased power is needed to generate a desired field intensity within gap 14; and third, many applications of magnets require a rapidly decreasing field outside magnet gap 14.

It is known to compensate for these fringing effects by introducing secondary coils, commonly called "correcting coils" into magnetic gap 14 in order to more closely approximate the desired field distribution. Correcting coils suffer from numerous disadvantages, they consume substantial amounts of power; they reduce the space available within the magnetic gap available for other purposes, and they add substantially to the cost of the apparatus.

Further, there is an additional problem which is not apparent from an examination of FIG. 1. In general the shape of the magnetic field is not stable with field intensity, particularly as the field increases to the point where the poles approach saturation (i.e., the maximum field which may be induced in the poles.) The actual radial field distribution is a highly complex function of the current in the magnet coil which is not susceptable to an analytic solution, but in general must be solved numerically for various values of current. This, of course, further increases the complexity of any system of correcting coils which is intended to correct a field shape which varies with intensity.

For these reasons, much effort has been devoted to finding shapes for the ends, or tips, of the poles which will produce fields of improved quality.

Thus, it is known to shape the pole tips so that the magnetic gap decreases with increasing radius, as is shown in FIG. 3, add supplemental pieces to the pole tips, known as "cleats", or "rose rings", to reduce fringing, as shown in FIG. 4, and to alter the average density distribution of metal in the pole tips by cutting notches 52 or drilling holes 62, as is shown in FIGS. 5 and 6, so that the average density increases with radius.

It is also known to form regions of the pole tips from a material such as "Invar" whose reluctance varies with temperature and to heat or cool these regions to alter the field shape.

All these techniques have been used separately and in various combinations in attempts to obtain satisfactory field distribution. While some success has been achieved, particularly for low and moderate fields, elaborate systems of correcting coils have still been needed and fully satisfactory results have not been achieved. In particular, the problem of field shape stability for varying intensity remained pressing.

Thus, it is an object of the subject invention to provide pole tips for a pair of magnetic poles defining a magnetic gap such that the desired magnetic field shapes in the gap are more easily achieved than has heretofore been possible.

It is also an object of the subject invention to provide pole tips for a pair of magnetic poles defining a magnetic gap such that fringing effects are reduced so that less power is needed to generate a particular field strength within the gap, and the field outside the gap falls more rapidly to zero.

It is a further object of the subject invention to provide pole tips for a pair of magnetic poles defining a magnetic gap such that the field shape is more stable with changes in field intensity than has heretofore been possible, particularly at field intensities which approach saturation of the poles.

Other objects and advantages of the subject invention will be apparent to those skilled in the art upon consideration of the summary of the invention and the detailed description set forth below.

BRIEF SUMMARY OF THE INVENTION

The disadvantages of the prior art are overcome and the above objects are achieved by means of an apparatus for the generation of a magnetic field. The apparatus comprises a pair of spaced, opposed magnetic poles, formed from a low reluctance material such as iron or steel, the poles further comprising a pole root and a pole tip attached to the central portion of said pole root. At least some opposed portions of the pole tips are separated from the pole root, the separation beginning at a predetermined radial distance from the center of the pole and increasing with radius. The pole tips thus define a magnetic gap wherein the magnetic field is accessible.

In a preferred embodiment of the subject invention the width of the magnetic gap between the opposed separated portions of the pole tips decreases with increasing radius.

DETAILED DESCRIPTION OF A PREFERRED EMBODIMENT OF THE INVENTION

A particularly useful application of magnetic apparatus of the type described above is in the construction of isochronous cyclotrons; apparatus wherein atomic particles are accelerated in an essentially spiral orbit in a magnetic gap of the type described above. The magnetic field confines the particles to the spiral orbit until they reach the desired energy at the edge of the gap, where they may be extracted. In general, the theory of cyclotrons is well known and understood and need not be discussed further here for an understanding of the subject invention. However, two aspects should be noted. The ideal field for an isochronous cyclotron is radially increasing since relativistic effects must be taken into account. Also, in order to vary the final energy of the particles the magnetic field intensity must be varied; and a minimal fringing field is highly desirable for such cyclotrons in order to simplify injection and extraction of particle beams and reduce power requirements. Thus, the problems discussed above relating to field shape, shape stability, and fringing field intensity are particularly important with respect to the design of magnetic poles for use in isochronous cyclotrons.

Figure 7:
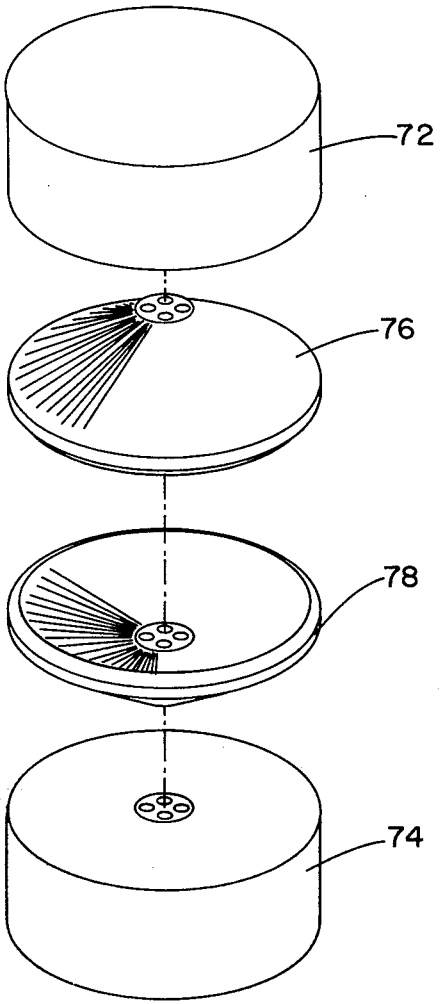
FIG. 7 shows an exploded isometric view of a pair of electromagnet poles in accordance with the subject invention.

Turning now to FIG. 7, there is shown a magnet in accordance with the subject invention in a simple embodiment. Pole roots 72 and 74 are formed from a low reluctance material and have the form of right cylinders. Pole tips 76 and 78 are also formed from a low reluctance material and have the form of truncated cones attached to the central portions of pole roots 72 and 74.

Figure 8A:
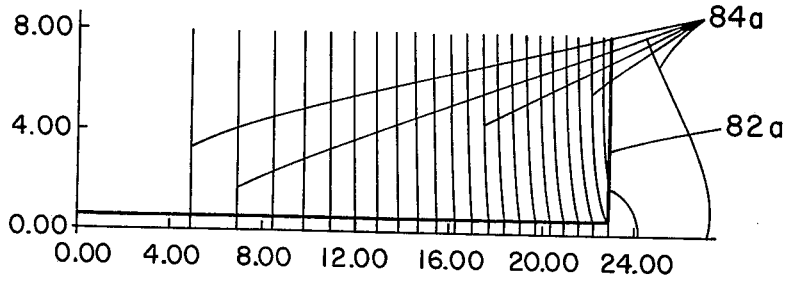
FIGS. 8*a–c* show quadrants of the magnetic gap for the electromagnetic poles of the subject invention, 8*c* and two other pole geometries, 8*a*, 8*b* and illustrate the effect on field shape of pole geometries.
Figure 8B:
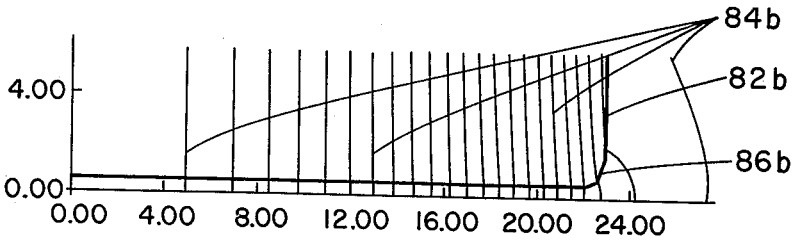
Figure 8C:
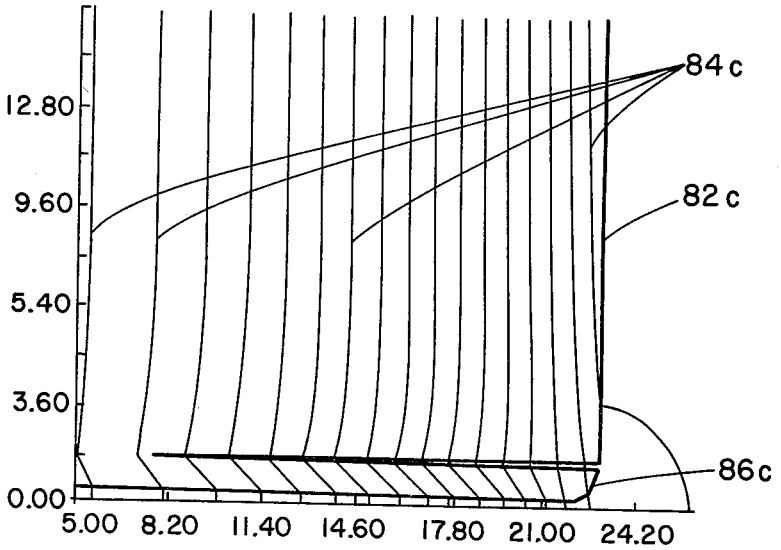

The improvement in fringing resulting from the addition of pole tips 76 and 78 may be seen in FIG. 8. FIG. 8*a* shows one quadrant of a magnetic gap. The poles 82*a*, of which one half of one is shown in cross-section, have the form of right cylinders. Computer simulations have shown the distribution of field lines 84*a*. FIGS. 8*b* and 8*c* show similar distribution of field lines 84*b* and 84*c* for poles 82*b*, which has an edge chamfer 86*b* to reduce fringing, and 82*c* which incorporates a pole tip 86*c* in accordance with the subject invention. It will be readily apparent to those skilled in the art that the pole tips of the subject invention show a dramatic reduction in the fringe field over the magnets shown in FIGS. 8*a* and 8*b*.

Figure 1:
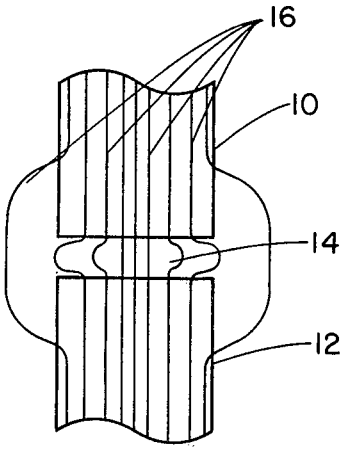
Fig. 1 PRIOR ART
FIG. 1 shows a cross-section of an idealized pair of electromagnet poles as known in the prior art with a schematic representation of the magnetic field.
Figure 3:
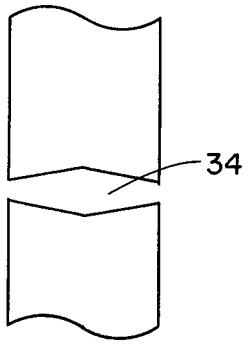
Fig. 3 PRIOR ART
FIG. 3 shows a cross-section of a prior art pole pair having a modified geometry.
Figure 2:
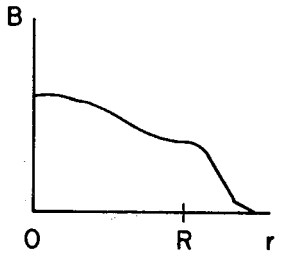
FIG. 2 shows a typical plot of magnetic field vs. radius for the poles of FIG. 1.
Figure 4:
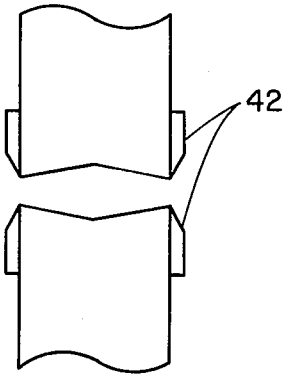
Fig. 4 PRIOR ART
FIG. 4 shows a cross-section of a prior art pole pair having a modified geometry.
Figure 5:
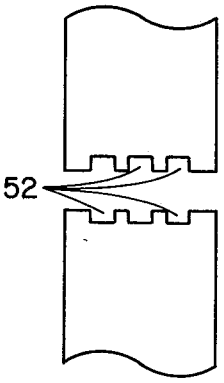
Fig. 5 PRIOR ART
FIG. 5 shows a cross-section of a prior art pole pair having a modified geometry.
Figure 6:
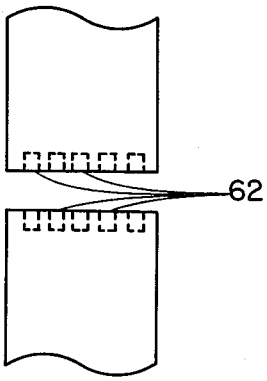
Fig. 6 PRIOR ART
FIG. 6 shows a cross-section of a prior art pole pair having a modified geometry.
Figure 9:
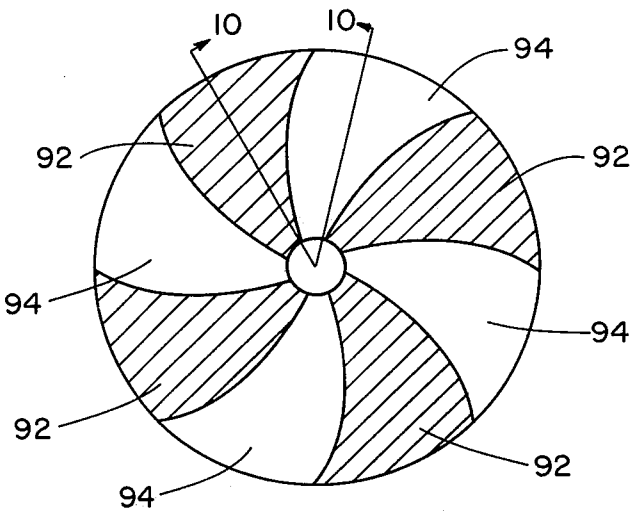
FIG. 9 shows a plan view of a pole tip suitable for use in a cyclotron.

Turning to FIG. 9, there is shown a plan view of a pole tip having a geometry suitable for use in a practical cyclotron. In contrast to the pole tips of FIGS. 7 and 8 the pole of FIG. 9 does not have azimuthal symmetry, rather raised sections 92, generally known as hills or ridges, alternate with lower sectors 94 to produce sectors of alternately stronger and weaker field. Such a field geometry is necessary to maintain the beam focus in a practical cyclotron of any substantial energy. The principles of this alternating field focussing are well known to those skilled in the cyclotron art and need not be described further here except to note that the fringing and field shape stability effects described above are dominated by the higher fields of the hill regions 92 and it has surprisingly been found that results substantially comparable to those calculated for the pole tip of FIG. 7 may be achieved by providing a linearly increasing separation only under the hills. It is, however, within the contemplation of the subject invention to provide such separation from the pole root beneath both hill and valley regions.

EXAMPLE I

Figure 10:
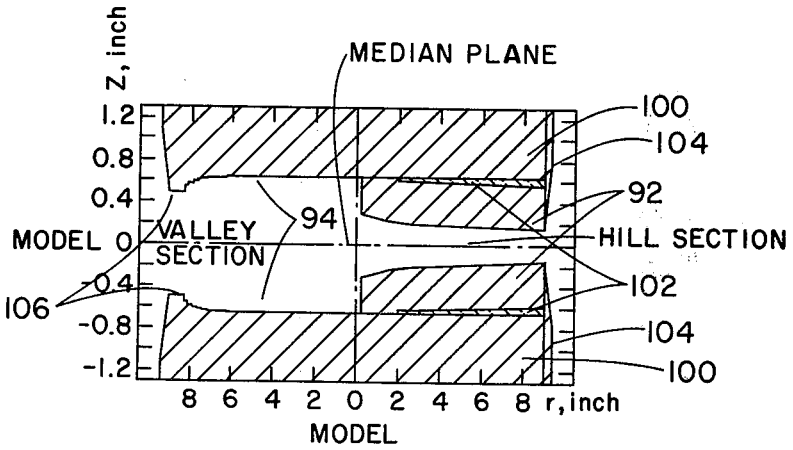
FIG. 10 shows a cross-section taken along line 10—10 of FIG. 9.

A model magnet was constructed to study various pole tip geometries for a variable energy, heavy ion, isochronous cyclotron proposed to the U.S. Department of Energy. FIG. 10 shows a to scale cross section, taken along line 10—10 of FIG. 9, of a pole tip geometry which proved to combine a radially increasing magnetic field with improved field shape stability. (Note that the vertical scale is exaggerated for clarity.)

Hill 92 is separated from pole root 100 by separation 102, which is filled with brass or some other high reluctance material for mechanical stability. Conventional edge cleats 104 were added to hills 92 and conventional "shims" 106 were added to valley section 94.

Figure 11:
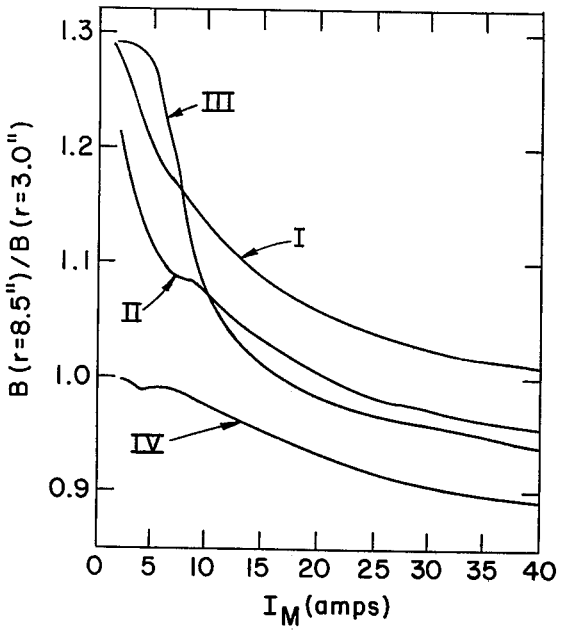
FIG. 11 shows a comparison of field shape and field shape stability for the pole tip geometry of the subject invention and various other geometries.

FIG. 11 shows a comparison of the field shape and field shape stability for the pole tip geometry of the subject invention with various other geometries. The various curves are plots of the ratio of the azimuthally averaged field strength at a radius of 8.5 inches to that at a radius of 3.0 inches versus current in the main magnet coils. Values greater than 1.0 show the desired radially increasing field shape while a small slope to the curves shows good field shape stability.

The pole tip geometries shown are as follows:

Curve I is for the pole tip geometry of FIG. 10.

Curve II is for a similar pole tip without cleats 104 and shims 106.

Curve III is for a similar pole tip without cleats 104 and shims 106 where the brass in separation 102 is replaced by a low reluctance material.

Curve IV is for a pole tip without cleats 104 and shims 106 and where the brass in separation 102 is replaced by a low reluctance material and hills 92 have a flat top with the separation between hills being equal to the average separation for the geometry of FIG. 10.

Examination of these curves shows that the flat hill geometry of curve IV is the most stable geometry, but gives a radially decreasing field for all but very low field strengths, while the solid wedge shaped hill geometry of curve III gives a radially increasing field for currents below about 17 amps but has poor field shape stability in that range. Addition of separation 102 provides improved stability down to a current of about 7–8 amps and extends the region of radially increasing field to a current of about 22 amps, as is shown by curve II. Finally, cleats 104 and shims 106 may be added to extend the region of radially increasing field beyond 40 amps without degrading the stability introduced by separation 102.

The above descriptions and examples and the attached drawings are provided by way of illustration only, and various other embodiments of the subject invention will be readily apparent to those skilled in the art. In particular, it should be noted that it is within the contemplation of the subject invention to incorporate the pole tips of the subject invention in permanent magnets, as well as electromagnets, and that radially increasing magnetic fields which may advantageously be provided by magnets in accordance with the subject invention are useful in other applications such as ion or electron confinement devices, and for various electron tubes employing magnetic fields (e.g. magnetrons). Thus, it should be understood that limitations on the subject invention are to be found only in the claims set forth below.

What is claimed is:

1. A magnet having reduced fringing and improved stability comprising a pair of spaced, opposed, magnetic poles, said poles being symmetrical about the mid-plane of the gap between them, each of said poles further comprising a pole root formed from a low reluctance material and a pole tip also formed from a low reluctance material, said pole tips being attached to the central portion of said pole roots, whereby said pole tips define the gap between said poles and at least one portion of said pole tips being separated from said pole roots, said separation beginning at a predetermined distance from the center of said pole and the amount of said separation being an increasing function of radial distance and independent of azimuth within said portion.

2. A magnet as described in claim 1 wherein the width of said gap decreases with increasing radius in tlose portions wherein said pole tips are separated from said pole root.

3. A magnet as described in claims 1 or 2 wherein said function is linear.

4. A magnet as described in claims 1 or 2 wherein said pole tips each comprise a raised sector so that said gap is reduced between said raised sectors and said raised sectors comprise said separated portions.

5. A magnet as described in claim 4, wherein said pole tips have a multiple symmetry about the axis of said poles and comprise a plurality of raised sectors separated azimuthally by lower sectors.

6. A magnet as described in claim 5, wherein cleats are provided at the edges of said higher sectors and shims are provided at the edges of said lower sectors whereby fringing is further reduced.

7. A magnet as described in claims 1 or 2 wherein said magnet is an electromagnet and said poles are operatively associated with a magnet yoke and coil for the generation of a magnetic field in the gap between said poles.

8. A magnet as described in claim 6 wherein said magnet is an electromagnet and said poles are operatively associated with a magnet yoke and coil for the generation of a magnetic field in the gap between said poles.

9. An isochronous cyclotron comprising an electromagnet as described in claim 7.

10. An isochronous cyclotron comprising an electromagnet as described in claim 8.

* * * * *